US006041533A

United States Patent [19]

Lemmond, Jr.

[11] Patent Number: 6,041,533

[45] Date of Patent: Mar. 28, 2000

[54] ADVERTISING STEP SYSTEMS

[76] Inventor: R. Nelson Lemmond, Jr., 1010 Guilford Rd., Charlotte, N.C. 28209

[21] Appl. No.: 09/013,242

[22] Filed: Jan. 26, 1998

[51] Int. Cl.[7] ..... G09F 7/00

[52] U.S. Cl. ..... 40/584; 40/594

[58] Field of Search ..... 40/584, 453, 594

[56] References Cited

U.S. PATENT DOCUMENTS

| | | |
|---|---|---|
| D. 267,459 | 1/1983 | Burt . |
| D. 345,878 | 4/1994 | Garon . |
| D. 350,253 | 9/1994 | Livingstone et al. . |
| D. 353,070 | 12/1994 | Hilton et al. . |
| D. 378,036 | 2/1997 | Chang . |
| 868,460 | 10/1907 | Grossman . |
| 1,051,354 | 1/1913 | Strachan . |
| 1,684,328 | 9/1928 | Molinelli . |
| 2,106,399 | 1/1938 | Beaumont et al. . |
| 2,216,250 | 10/1940 | Nelson . |
| 2,843,868 | 7/1958 | Borgstrom . |
| 4,109,439 | 8/1978 | Feasel . |
| 5,022,198 | 6/1991 | Lower . |
| 5,137,340 | 8/1992 | Cugley et al. . |
| 5,176,239 | 1/1993 | Findlay et al. . |
| 5,411,127 | 5/1995 | Findlay . |
| 5,439,090 | 8/1995 | Findlay . |
| 5,468,532 | 11/1995 | Ho et al. . |
| 5,491,015 | 2/1996 | Reeves et al. . |
| 5,587,218 | 12/1996 | Betz . |
| 5,775,016 | 7/1998 | Chien ..... 40/544 |

FOREIGN PATENT DOCUMENTS

| | | | |
|---|---|---|---|
| 671932 | 9/1929 | France | 40/453 |

OTHER PUBLICATIONS

Pop Times, vol. 10, No. 2, Feb. 1997, "Floor Graphics Update", pp. 45–54.

*Primary Examiner*—Cassandra H. Davis
*Attorney, Agent, or Firm*—Karen Lee Orzechowski; Alston & Bird, LLP

[57] ABSTRACT

An advertising system for displaying images on a series of offset stationary vertical surfaces is disclosed. The advertising system includes a plurality of substrates, each having a layer of printed indicia on a surface thereof in combination with the series of offset stationary vertical surfaces to provide a desired overall visual image.

22 Claims, 1 Drawing Sheet

ADVERTISING STEP SYSTEMS

FIELD OF THE INVENTION

This invention relates to advertising step systems and more particularly to advertising step systems for use on vertical or riser surfaces of stationary stairs.

BACKGROUND OF THE INVENTION

Numerous types of media are used to advertise products and services in various settings. The type of advertising media used can vary depending upon the environment in which it is placed.

For example, large billboards and other types of signage or displays along highways, on windows, on sides of vehicles, and the like can be effective in attracting the attention of persons passing the display. Point of purchase displays are another advertising option, often used to direct a consumer's attention to product offerings placed inside a store. A specific example of a current industry trend in the point of purchase area is referred to as "floor graphics." Floor graphics is an industry term used to refer to a substrate with graphics printed on a surface thereof, which is placed on the floor near a product display to direct a consumer's attention to a particular product display.

Various types of advertising media can also be effective to attract the attention of a large group of people, for example, in a stadium or other large arena setting. For example, large graphical displays associated with a digital scoreboard are often used in stadium settings to attract the attention of a large number of people attending a particular event. While effective, such displays can be expensive and time consuming to program, display and change.

SUMMARY OF THE INVENTION

The present invention provides an advertising system useful for displaying visual images and is particularly useful in settings which can seat a large number of spectators, such as stadiums, amphitheaters, arenas, baseball parks, concert facilities, movie houses, and the like, hereinafter collectively referred to as "stadiums." The advertising system of the invention includes a plurality of individual substrates, each of which carries a visual image or graphic on a surface thereof. The substrates are releasably attached to a series of stationary offset vertical surfaces, for example, the front surfaces of risers of a stairway.

Each individual printed substrate can carry a different visual image. Alternatively, each individual printed substrate can carry the same visual image so that the combination of the substrates when attached to a series of offset vertical surfaces provides a repetitive pattern of the same image. In yet another embodiment of the invention, each substrate can include a specific portion of a single visual image, for example, a soft drink bottle, so that when the substrates are placed in a specific sequence on the series of offset vertical faces, the discrete images form an overall coherent visual image, i.e., a picture of the bottle as a whole. The advertising systems of the invention are particularly useful on stationary stairways found in basketball arenas, football stadiums, and similar venues as noted above.

Preferably, the substrate is formed of a flexible material, such as a polymeric material, but other materials can also be used. In addition, the substrate can include a clear or transparent coating to protect the substrate and the graphic carried thereby. Such coatings can, for example, impart weatherability, abrasion resistance, and the like.

Each of the individual substrates can be releasably attached to a corresponding stationary vertical surface using a suitable adhesive. Preferably, the adhesive is capable of adhering the substrate to a surface securely yet also allows for the ready and easy removal of the substrate with minimal adhesive residue. Alternatively, the substrates can be releasably attached to the vertical surfaces using mechanical devices, such as screw, bolts, and the like.

The advertising system of the invention provide a striking visual image which can be viewed by a large number of persons at the same time. Further, the graphical images can be readily changed to provide versatility to the system. Still further, the advertising system of the invention can be installed with minimal or essentially no retrofitting of existing structures.

BRIEF DESCRIPTION OF THE DRAWINGS

Some of the features and advantages of the invention having been described, others will become apparent from the detailed description which follows, and from the accompanying drawings, in which.

DETAILED DESCRIPTION OF THE INVENTION

The present invention will be described more fully hereinafter with reference to the accompanying drawings, in which an illustrative embodiment of the invention as shown. This invention may, however, be embodied in many different forms and should not be construed as limited to the embodiments set forth herein. Rather, this embodiment is provided so that the disclosure will be thorough and complete, and will fully convey the scope of the invention to those skilled in the art. Like numbers refer to like elements throughout. For purposes of clarity, the scale has been exaggerated.

Figure 1:
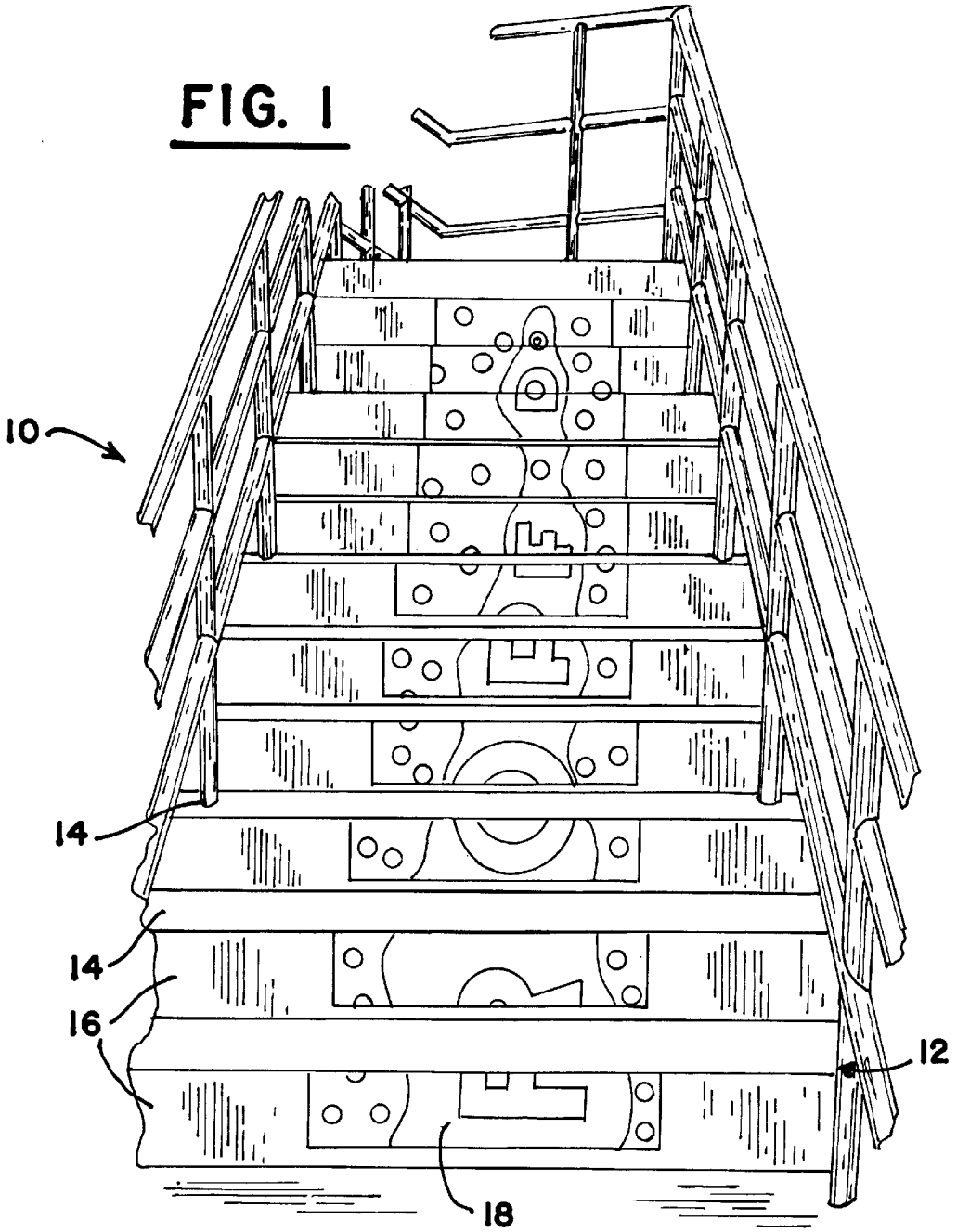
FIG. 1 is a perspective view of an exemplary embodiment of the advertising system of the invention displayed in a stadium setting and illustrating the overall visual impact of a system of the invention.

FIG. 1 illustrates a perspective view of an exemplary embodiment of the advertising system of the invention in the environment of a stadium or arena. A typical stadium includes an event area and a plurality of tiers of rows of spectator seats rising gradually outward from the event area and grouped together to form sections. The rows of seats in a given section are usually bounded by vertical aisles or stairways capable of accommodating the passage of individuals moving about between the sections and between lower and upper rows of the sections.

Such a stairway is illustrated in FIG. 1 and is designated generally as 10. Stairway 10 includes a plurality of stair steps 12 and each individual stair step includes a horizontal tread 14 and a vertical riser 16. Also as illustrated in FIG. 1, the advertising systems of the invention include a plurality of substrates 18, each of which is releasably attached to a corresponding front face of an individual riser. As described in more detail below, each individual substrate 18 carries a visual image.

A variety of visual images can be imparted by the grouping of the individual substrates on a series of offset stationary vertical surfaces. For example, as illustrated, each of the substrates can carry a layer of printed indicia which includes a discreet portion of a single overall visual image. In this embodiment of the invention, each individual substrate is releasably attached to a corresponding front face of a riser in series so that the combination of the substrates after attachment to the risers produces a single overall visual image. Alternatively, each individual substrate can carry an identical visual image, for example, each substrate can include a slogan, product name, and the like. In this embodiment of the invention, when each individual substrate is releasably attached to the front face of a corresponding riser, the plurality of substrates creates a repeating pattern of the same visual image. Still further, each individual substrate can carry different visual images so that attachment of the substrates to the front face of individual risers creates a plurality of different images in sequence.

Figure 2:
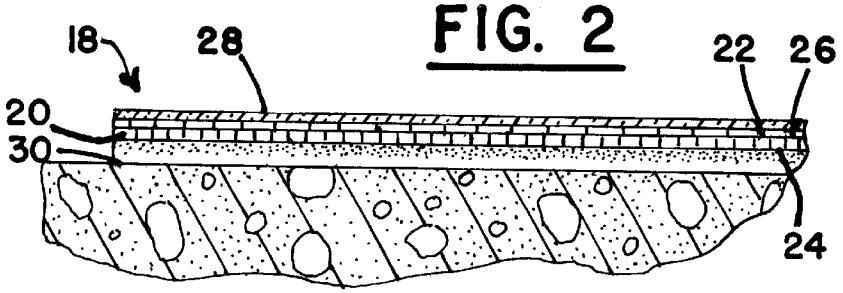
FIG. 2 is a cross-sectional view of an individual substrate component of the advertising system of the invention.

Turning now to FIG. 2, a cross-sectional view of an exemplary substrate component of the advertising system of the invention is illustrated. The substrate material 18 includes a substrate 20 having opposed first and second surfaces 22 and 24, which ultimately will face outwardly and inwardly, respectively, in the advertising system.

The dimensions of the substrate 20 can vary, depending upon the dimensions of the vertical surface to which is it to be secured, the desired configuration of the visual image to be imparted, and the like. Accordingly, although illustrated as rectangular sheet materials in FIG. 1, each substrate can have a circular, oval, square, irregular, or other shape, or individual substrates within the grouping can have different shapes.

Preferably, each substrate 20 is a flexible substrate, such as that formed of a thermoplastic polymeric sheet material, although other suitable substrates, such as paper substrates, fabric substrates, metal substrates, wood substrates, and the like, and combinations thereof, can also be used. Exemplary flexible thermoplastic polymer base materials include without limitation polyolefins, such as polyethylene and polypropylene; vinyl polymers and copolymers, such as polyvinylchloride (PVC), polystyrene, and the like; acrylate polymers such as polymers and copolymers of acrylic acid and methacrylic acid and their amides, esters, salts and corresponding nitrites; polyamides; polyesters; blends and copolymers of these and other thermoplastic polymers; and the like. These and other polymeric materials are well known in the art.

As also illustrated in FIG. 2, substrate 20 includes a layer of printed indicia 26 on outwardly facing surface 22 to impart a desired visual image. Substrate 20 can be printed with a variety of different decorative designs, ranging from simple to complex patterns and from monochromatic to multi-colored patterns, words, etc. The desired design can be printed onto the surface of substrate 20 using conventional printing techniques, such as screenprinting, lithography, digital printing, and the like.

Substrate 18 of the advertising system of the present invention can optionally include a protective layer 28 along exterior surface 22 of the substrate 20. Preferably, protective layer 28 is formed of a polymer that is substantially clear or transparent. The protective surface layer can be formulated to render the substrates carrying the graphic design suitable for use in outdoor environments or it may be designed for less demanding interior applications. As used herein, the term "substantially clear" or "transparent" means that the underlying design can be seen through the surface layer such that the surface layer does not detract from the appearance of the design.

The transparent protective surface layer may be formed of various materials known in the art, depending on the degree of protection to be afforded to the underlying layers of the substrate and the nature of the substrate. For example, articles intended for outdoor use may need to be weatherable, abrasion resistant, and resistant to chemical exposure. Polymers suitable for forming such protective layers are preferably weatherable polymers selected to provide a layer which will not significantly fade, peel, or crack when exposed to the environment for the intended life of the product. Exemplary polymers include fluoropolymers, acrylate polymers, urethane polymers, vinyl polymers, and blends and copolymers thereof, and are well known in the art.

As discussed above, the advertising system of the invention further includes attachment means for releasably attaching each individual substrate to a corresponding face of a riser. In a preferred embodiment of the invention, as illustrated in FIG. 2, the attachment means comprises an adhesive layer 30 which releasably adheres each substrate to the front surface of a corresponding riser.

Adhesive layer 30 can be formed of any of a variety of adhesives conventionally employed to bond articles to a surface. Such adhesives are within the knowledge of the skilled artisan and are commercially available. Preferably, the adhesive is a pressure sensitive adhesive. Exemplary pressure sensitive adhesives include ethylene copolymers, such as ethylene vinyl acetate copolymers; acrylate esters; polyolefin-based polymers, such as polypropylene- or polyethylene-based polymers; and the like.

As will be appreciated by the skilled artisan, to protect the adhesive prior to use of the decorative substrate, a release liner is releasably adhered to a surface of the adhesive layer opposite the substrate. The release liner sheet can include conventional release liners as known in the art, which typically include silicone coated paper or polymeric films, and the like.

Although a preferred embodiment has been illustrated demonstrating an adhesive attachment mechanism, the skilled artisan will appreciate that the individual decorative substrates can be attached to a front surface of a riser using known mechanical attachment devices, such as screws or bolts penetrating the substrate material to engage the material with the riser of the stair steps, a frame or other suitable mounting device attached to a front surface of a riser which can hold the graphic substrate in the desired position adjacent the front surface of the riser, and the like.

In another alternative embodiment of the invention, the graphic substrate can include a layer of printed indicia on a surface 24 facing inwardly toward the surface to which the substrate is attached, so long as substrate 20 is formed of a suitable transparent material. Such a construction is sometimes referred to in the art as a "buried graphic." Buried graphics afford the underlying printed layer additional protection against environmental weathering, chemical exposure, and abrasion.

A currently preferred decorative substrate is commercially available from 3M as "3M Floorminders Graphics."

The multi-layer decorative articles used in the advertising system of the invention can be readily manufactured using known techniques. For example, for those constructions including a polymeric film layer substrate, the film layer may be cast, extruded, calendared or blown and subsequently primed or otherwise treated to improve adhesion to subsequently applied layers if necessary. The printed indicia can be coated, screen printed, transfer laminated, or the like to the film layer, as can the protective surface layer and adhesive when present. The order of these manufacturing steps may be varied as will be appreciated by the skilled artisan.

The invention is defined by the following claims, with equivalents of the claims to be included therein.

That which is claimed is:

1. An advertising system for presenting a single visual image on a series of horizontally and vertically offset vertical surfaces, said system comprising:

a series of offset non-collapsible stationary horizontally and vertically offset vertical surfaces in a fixed and non-movable relationship;

a plurality of substrates each carrying a discrete portion of said singe visual image, wherein each substrate comprises a weather resistant laminate comprising a flexible thermoplastic polymer base film with a front surface and a back surface, a layer of printed indicia on said front surface forming said discrete portion of said single visual image, a protective layer integral with said layer of printed indicia so that the printed indicia is visible, and an adhesive backing on said back surface;

wherein each of said substrates containing a partial image forming a discrete portion of said single visual image is releasably attached to a corresponding vertical surface in said series of vertical surfaces so that the combination of substrates produces said single visual image.

2. The advertising system of claim 1 wherein said series of offset non-collapsible stationary vertical surfaces is a plurality of non-collapsible stationary stair steps each having a vertical riser and a horizontal tread portion.

3. The advertising system of claim 2 wherein said vertical risers have a front face and said substrates are releasably attached to said front faces.

4. The advertising system of claim 1 wherein the protective layer is an ultra violet protective layer.

5. The advertising system of claim 1 wherein the protective layer is transparent.

6. The advertising system of claim 5 wherein said protective layer is a coating of a polymer selected from the group consisting of fluoropolymers, acrylate polymers, urethane polymers, vinyl polymers, blends thereof, and copolymers thereof.

7. The advertising system of claim 1 wherein the protective layer is incorporated in the printed indicia.

8. The advertising system of claim 1 wherein said adhesive layer is a pressure sensitive adhesive.

9. The advertising system of claim 8 wherein said pressure sensitive adhesive is selected from the group consisting of ethylene copolymers, acrylate esters, and polyolefin-based polymers.

10. The advertising system of claim 1 wherein said printed indicia is applied to said base film by coating.

11. The advertising system of claim 1 wherein said printed indicia is applied to said base film by screen printing.

12. The advertising system of claim 1 wherein said printed indicia is applied to said base film by transfer laminating.

13. An advertising system for displaying visual images on a plurality of horizontally and vertically offset stationary vertical surfaces, comprising:

a plurality of stationary stair steps, each of said steps comprising a tread and a riser having a vertical face; and a plurality of substrates each carrying a discrete portion of said visual image, wherein each of said substrates comprises a weather resistant laminate comprising a flexible thermoplastic polymer base film with a front surface and a back surface, a layer of printed indicia on said front surface, a protective layer integral with said layer of printed indicia, and an adhesive layer on said back surface for releasably attaching each of said substrates to a corresponding front face of an individual riser to display said printed indicia, wherein each layer of printed indicia comprises a discrete portion of a single visual image, and wherein each of said substrates is arranged and releasably attached to a corresponding vertical face of individual risers so that the combination of the substrates after attachment to said corresponding vertical faces produces said single overall visual image.

14. The advertising system of claim 13 wherein the protective layer is an ultra violet protective layer.

15. The advertising system of claim 13 wherein the protective layer is transparent.

16. The advertising system of claim 15 wherein said protective layer is a coating of a polymer selected from the group consisting of fluoropolymers, acrylate polymers, urethane polymers, vinyl polymers, blends thereof, and copolymers thereof.

17. The advertising system of claim 13 wherein the protective layer is incorporated in the printed indicia.

18. The advertising system of claim 13 wherein said adhesive layer is a pressure sensitive adhesive.

19. The advertising system of claim 18 wherein said pressure sensitive adhesive is selected from the group consisting of ethylene copolymers, acrylate esters, and polyolefin-based polymers.

20. The advertising system of claim 9 wherein said printed indicia is applied to said base film by coating.

21. The advertising system of claim 9 wherein said printed indicia is applied to said base film by screen printing.

22. The advertising system of claim 9 wherein said printed indicia is applied to said base film by transfer laminating.

* * * * *